US008636073B2

(12) United States Patent
McNeilly

(10) Patent No.: US 8,636,073 B2
(45) Date of Patent: Jan. 28, 2014

(54) SEGMENTED BALL SEAT ASSEMBLY VALVE

(75) Inventor: Arthur Keith McNeilly, Houma, LA (US)

(73) Assignee: Arthur Keith McNeilly, Houma, LA (US)

( * ) Notice: Subject to any disclaimer, the term of this patent is extended or adjusted under 35 U.S.C. 154(b) by 389 days.

(21) Appl. No.: 13/079,513

(22) Filed: Apr. 4, 2011

(65) Prior Publication Data

US 2011/0240315 A1 Oct. 6, 2011

Related U.S. Application Data

(60) Provisional application No. 61/320,958, filed on Apr. 5, 2010.

(51) Int. Cl.
*E21B 34/06* (2006.01)

(52) U.S. Cl.
USPC ..... 166/386; 166/373; 166/318; 166/334.4

(58) Field of Classification Search
USPC ..... 166/386, 373, 318, 334.4; 251/359, 251/360, 363; 137/508
See application file for complete search history.

(56) References Cited

U.S. PATENT DOCUMENTS

| | | | | |
|---|---|---|---|---|
| 4,823,882 | A * | 4/1989 | Stokley et al. | 166/387 |
| 5,960,881 | A | 10/1999 | Allamon | |
| 5,960,884 | A * | 10/1999 | Echols | 166/317 |
| 2010/0319927 | A1 * | 12/2010 | Yokley et al. | 166/373 |

* cited by examiner

*Primary Examiner* — Cathleen Hutchins
(74) *Attorney, Agent, or Firm* — Bracewell & Giuliani LLP

(57) ABSTRACT

The segmented ball seat valve is an annular communication valve normally installed in a string of pipe that is to be deployed to a depth within a well. The segmented ball seat valve provides communication between the inside of the pipe and the well bore or casing through open ports. The segmented ball seat valve can be closed to shut off communication by dropping/pumping a ball to the segmented ball seat valve and applying pressure to close the valve. The application of pressure causes the ball seat assembly to move downward into an enlarged portion of the bore. The segments of the seat assembly move outward in the enlarged area to permit passage of the ball.

20 Claims, 3 Drawing Sheets

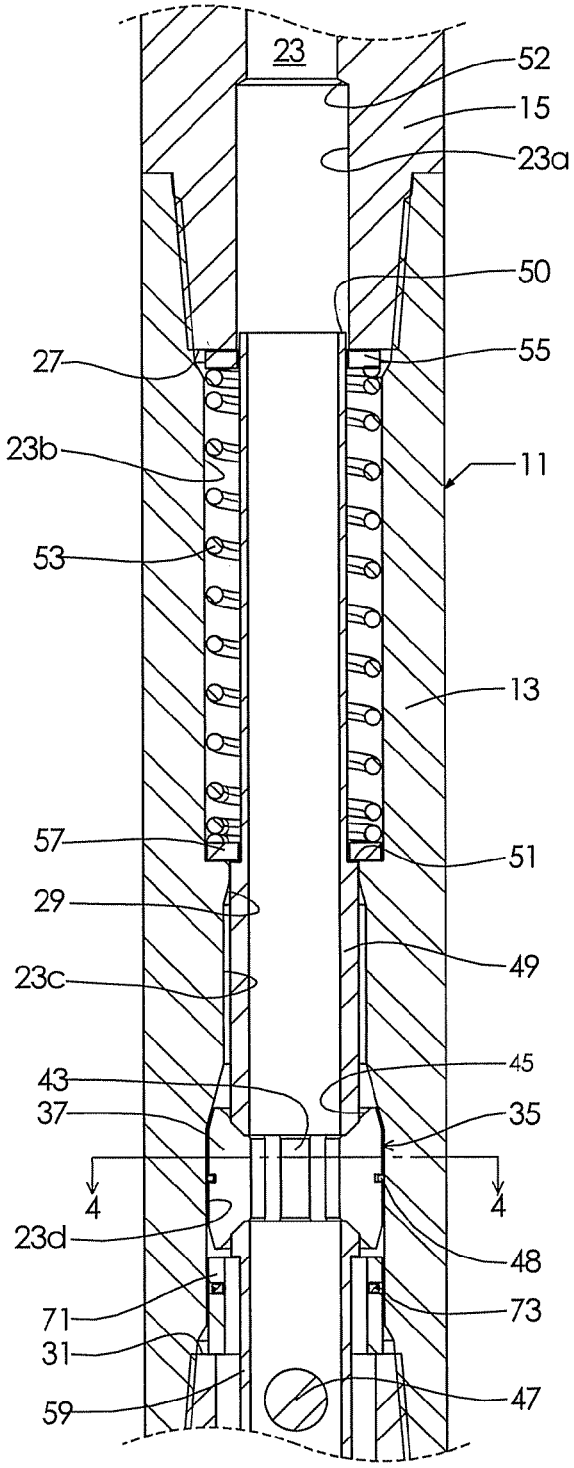
FIG. 2A
FIG. 2B
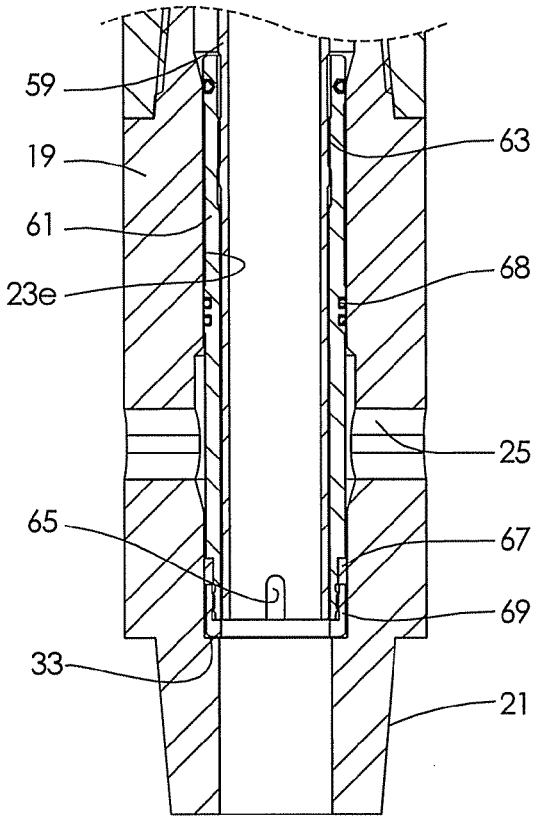
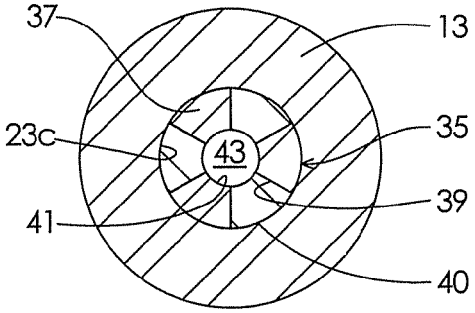
FIG. 3

SEGMENTED BALL SEAT ASSEMBLY VALVE

CROSS-REFERENCE TO RELATED APPLICATION

This application claims priority to provisional application Ser. No. 61/320,958, filed Apr. 5, 2010.

FIELD OF THE INVENTION

This invention relates generally to downhole oil and gas well equipment and in particular to a seat assembly mounted in well pipe that receives a ball or the like dropped down the pipe from the surface, the seat assembly being movable to perform a function upon the application of fluid pressure after the ball has landed.

BACKGROUND OF THE INVENTION

A technique employed in oil and gas well drilling, completion and workover operations involves dropping or pumping a sealing member down the well pipe onto a seat assembly. The sealing or drop member is typically a ball or dart. After the drop member lands on the seat assembly, it forms a seal, allowing the operator to apply increased fluid pressure in the well pipe above the seat assembly. A shear member shears, allowing the seat assembly to move downward to perform a specified function, such as opening or closing ports in the well pipe.

In one use, a seat assembly of this nature may form part of an annular communication valve, which is utilized at some point during the drilling or producing life of an oil or gas well to perform a variety of services. The valve can be used in a system to reduce surge pressure while deploying a liner. Typically, the valve includes a sliding sleeve and a seat assembly deployed in the open position with the sliding sleeve positioned above ports that are open to the annulus. Once the ball has landed on the ball seat assembly, applied pressure shifts the sleeve to cover and seal off the ports.

If running a liner string, cementing may occur after the ball has been released. It is important that the valve be shifted to the fully closed position before the ball is released. Otherwise, an operator might not realize the ports are still open and begin pumping cement down the pipe string. Instead of all of the cement flow out the lower end of the liner string, as required, some of the cement could inadvertently be diverted out the still open valve ports.

In some cases, tools located below the valve will require activation by dropping/pumping another ball or dart to the tool. Therefore, it is desirable for the valve to contain a ball seat assembly that permits passage of another and larger diameter ball once the valve has been shifted by the first ball. The reason for requiring a larger diameter ball is to avoid the first ball inadvertently shifting a lower seat valve after it has shifted and passed through the upper seat. Additionally, the second ball used to land on the lower seat must not be so large in diameter that it has difficulty passing through the upper seat after it has shifted. Breakaway or yieldable ball seat assemblies are known to provide for passage of the ball after shifting. However, if a second ball has to pass through the upper seat after it has broken away, problems can occur. The second ball may have difficulty passing through the upper seat after it has broken away, requiring greater pressure force. Additionally, if the sliding sleeve travel is impeded, the ball can possibly be forced though the yieldable seat assembly without fully closing the sleeve.

SUMMARY

A well tool apparatus has a tubular housing having upper and lower ends for coupling into a pipe string extending into a well. The housing has an axially extending bore with an enlarged diameter portion. A seat assembly is mounted in the bore in a first position above the enlarged diameter portion for receiving a drop member, such as a ball, conveyed down the pipe string. The seat assembly has a passage therethrough that is blocked by the drop member after the drop member lands on the seat assembly. A retainer retains the seat assembly in the bore above the enlarged diameter portion. The retainer allows the seat assembly to move downward from the first position to a second position in the enlarged diameter portion in response to a selected fluid pressure applied in the bore above the seat assembly after the drop member has landed on the seat assembly. The seat assembly is radially expansible while in the enlarged diameter portion so as to enlarge a diameter of the passage sufficiently to allow the drop member to pass through the passage.

The seat assembly may comprise a plurality of separate seat assembly segments positioned in a circumferential array and in side-to-side abutment with each other while in the bore above the enlarged diameter portion. A spring may be mounted in the bore above the seat assembly and cooperatively engaged with the seat assembly for urging the seat assembly downward.

In one embodiment, a tubular upper mandrel is carried in the bore for axial movement relative to the housing. The upper mandrel has a lower end in abutment with the seat assembly. A spring is compressed between an upper portion of the housing and an upward facing shoulder on the upper mandrel, applying a bias force to the upper mandrel and the seat assembly in a downward direction.

A tubular lower mandrel has an upper end in abutment with the seat assembly while the seat assembly is in the first position. The lower mandrel is downwardly movable with the seat assembly while the seat assembly moves from the first to the second position. The retainer may comprise a shear member coupled between the housing and the lower mandrel. The shear member shears to allow the lower mandrel and the seat assembly to move downward in response to the selected pressure. In one embodiment, the lower mandrel comprises inner and outer sleeves secured to each other by threads such that rotating one of the sleeves relative to the other changes a length of the lower mandrel.

In the embodiment shown, a downward facing shoulder is located in the bore against which an upper portion of the seat assembly abuts while in the first position. The downward facing shoulder prevents upward movement of the seat assembly in the bore from the first position, but allows downward movement of the seat assembly to the second position.

The ball seat may be employed as part of a valve to open or close a port in a sidewall of the housing. In one embodiment, seals on the lower mandrel block fluid communication between the bore and the port while the seat assembly is in one of the positions and allow fluid communication between the bore and the port while in the other of the positions.

BRIEF DESCRIPTION OF THE DRAWINGS

FIGS. 2A and 2B comprise a side cross-section of the segmented ball seat valve of FIGS. 1A and 1B shown in the closed position.

FIG. 3 is a sectional view of the segmented ball seat valve of FIGS. 1A and 1B taken along the line 3-3 of FIG. 1A.

DETAILED DESCRIPTION OF THE DISCLOSURE

Figure 1A:
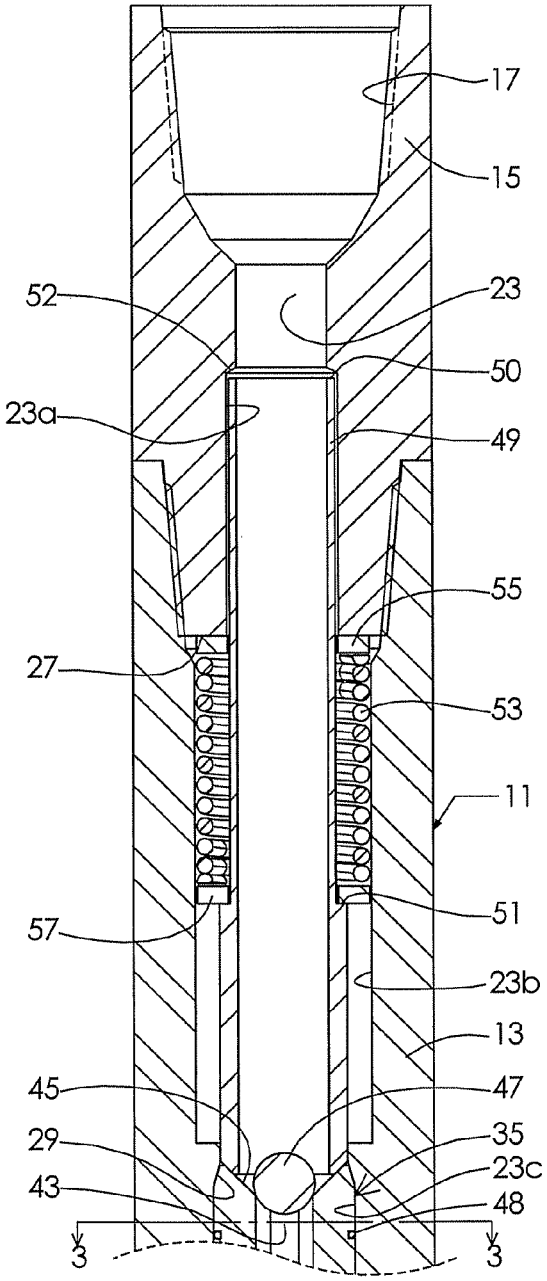
FIGS. 1A and 1B comprise a side cross-section of a segmented ball seat valve in accordance with this disclosure and shown in the open position.
Figure 1B:
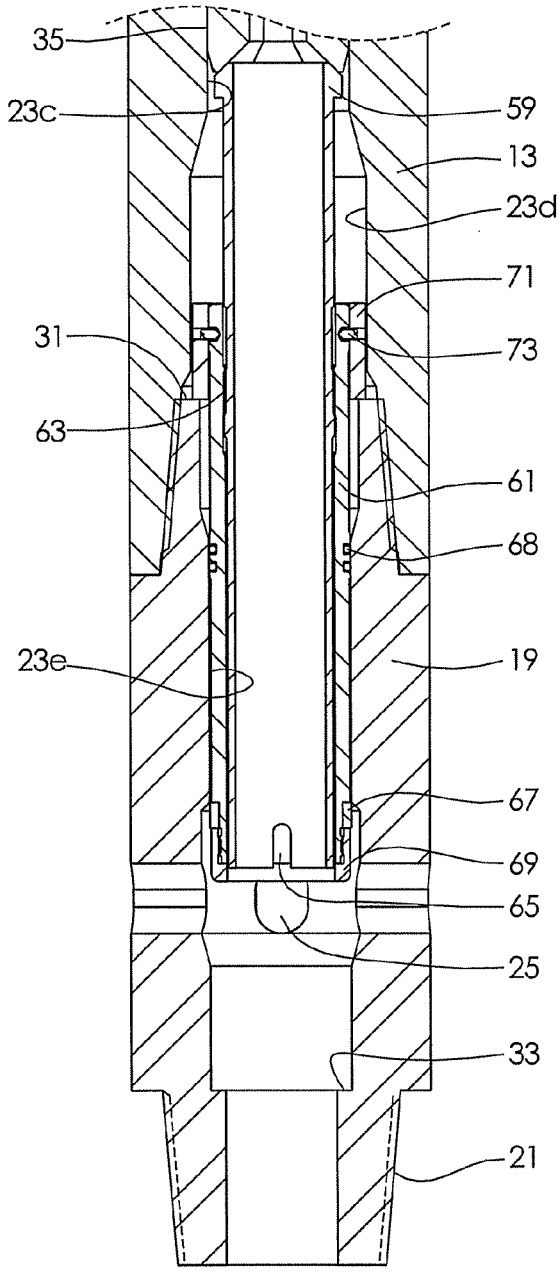

Referring to FIGS. 1A and 1B, valve assembly 11 has a tubular housing 13. Housing 13 includes an upper adapter 15 secured by threads to the upper end of a central portion of housing 13. Upper adapter 15 has internal threads 17 for securing to a string of well pipe (not shown). In this example, the well pipe comprises drill pipe, but it could be other types of pipe, including tubing, casing and liner pipe. Housing 13 also includes a lower adapter 19 secured by threads to a lower end of the central portion of housing 13. Lower adapter has external threads 21 for securing to a string of well pipe.

A bore 23 extends axially through housing 13, including adapters 15 and 19. Bore 23 has an upper portion 23*a* within upper adapter 15 and an intermediate portion 23*b* of larger diameter in the central portion of housing 13. A receptacle portion 23*c* of smaller diameter than intermediate portion 23*b* joins and is located below intermediate portion 23*b*. An enlarged bore portion 23*d* of diameter larger than receptacle portion 23*c* joins and extends downward from receptacle portion 23*c*. A lower portion 23*e* having a smaller diameter than enlarged portion 23*d* extends through lower adapter 19.

In this embodiment, one or more ports 25 are located in lower adapter 19, each extending through the sidewall of lower adapter 19 from lower bore portion 23*e*. Upper adapter 15 has a lower end 27 that defines a downward facing shoulder at the upper end of intermediate bore portion 23*b*. A receptacle shoulder 29 is located at the upper end of receptacle portion 23*c* and tapers inward. Lower adapter 19 has a rim 31 that defines an upward facing shoulder at the lower end of bore enlarged diameter portion 23*d*. Lower adapter 19 has an upward facing shoulder 33 in lower bore portion 23*e* approximately at the upper end of threads 21.

Figure 4:
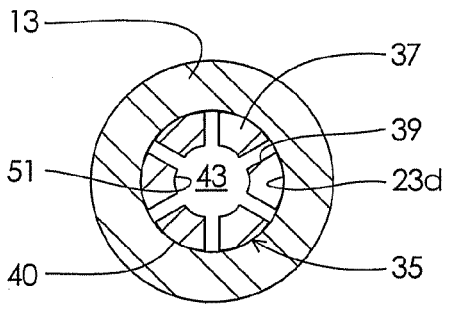
FIG. 4 is a sectional view of the segmented ball seat valve of FIGS. 1A and 1B taken along the line 4-4 of FIG. 2A.
Figure 5:
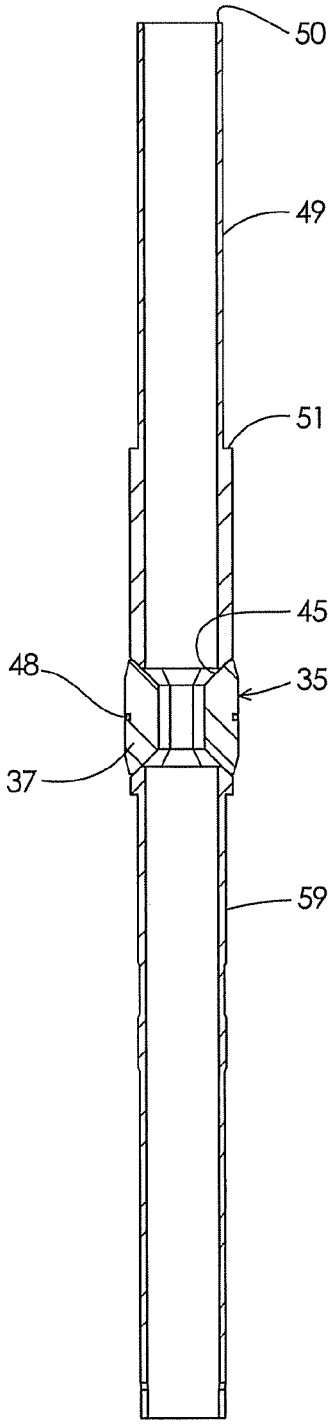
FIG. 5 is a side cross-section of the seat assembly of the valve of FIGS. 1A and 1B, shown with the seat assembly in, the contracted position and shown removed from the housing.
Figure 6:
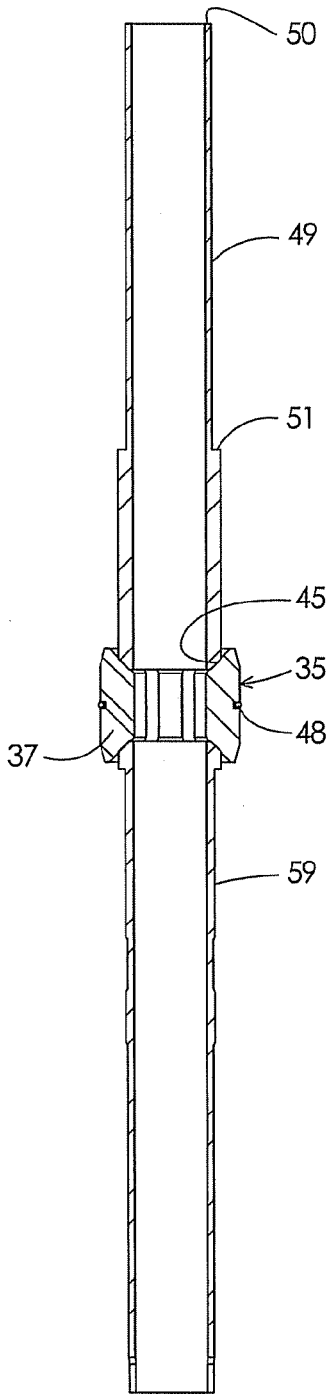
FIG. 6 is a side cross-section of the seat assembly of FIG. 5 shown in the expanded position.

A seat assembly 35 is releasably mounted in receptacle portion 23*c*. Seat assembly 35 has an upper end that tapers and mates with shoulder 29, preventing upward movement of seat assembly 35 in bore 23. When moved from receptacle portion 23*c* into enlarged diameter portion 23*d*, seat assembly 35 radially expands. In the embodiment shown, radial expansion is accomplished by seat assembly 35 being made up of a plurality of segments 37, as illustrated in FIG. 3. Each segment 37 is generally pie-shaped, having radially extending side surfaces 39 that abut each other when in the contracted or initial position of FIGS. 1A, 1B and 3. Each segment 37 has an outer circumferential portion 40 that is part of a cylinder and mates with the outer circumferential portions 40 to define a continuous outer diameter. Each segment 37 has an arcuate inner portion 41 that is partially cylindrical and mates with the inner portions 41 of the other segments 37 to define an initial inner diameter for a central passage 43. When moved into enlarged diameter portion 23*d*, segments 37 move radially outward, which separates side surfaces 39 from each other, as shown in FIG. 4. The effective inner diameter of inner passage 43 increases as well as the outer diameter of seat assembly 35.

The upper side of each segment 37 is a portion of a cone. While in its initial position, seat assembly 35 defines a conical seat surface 45 for receiving a ball 47 dropped or pumped down the pipe string from the surface. Ball 47 may be another type of conventional drop member, such as a dart. Ball 47 has a diameter that is larger than the diameter of passage 43 while seat assembly 35 is in its initial position. When ball 47 lands on seat surface 45, it thus forms a seal, blocking any downward fluid flow through passage 43. Sealant may be placed on the mating side surfaces 39 of segments 37 to retard leakage between the side surfaces 39 while they abut each other. A stretchable seal 48, such as of an elastomeric material, fits around the outer diameter of seat assembly 35 and seals against the inner diameter of receptacle portion 23*c*.

In this embodiment a bias force acts downwardly on seat assembly 35 while it is in receptacle portion 23*c*. The bias force is provided in this example by an upper mandrel 49, which is a tubular member having an upper end 50 located in upper bore portion 23*a*. Upper end 50 is shown adjacent a downward facing shoulder 52 in upper bore portion 23*a*, but it could be spaced below out of contact with shoulder 52 while seat assembly 35 is in receptacle portion 23*c*. Upper mandrel 49 has an upward facing external shoulder 51. The lower end of upper mandrel 49 abuts a portion of seat surface 45 of seat assembly 35.

A coil spring 53 encircles upper mandrel 49 and has an upper end washer 55 that abuts upper adapter lower end 27. A lower end washer 57 abuts upper mandrel shoulder 51. Spring 53 is thus located in intermediate bore portion 23*b* and is compressed between upper adapter lower end 27 and upper mandrel shoulder 51. The compression exerts a downward bias force on seat assembly 35. Arrangements other than employing upper mandrel 49 could be employed for exerting a downward bias force on seat assembly 35.

A retainer assembly prevents the bias force from spring 53 from pushing seat assembly 35 downward from seat receptacle 23*c* until a selected fluid pressure in bore 23 above seat assembly 35 is reached. The retainer assembly includes a lower mandrel 59 located below and having an upper end in abutment with seat assembly 35. Lower mandrel 59 in this example has an overall length that may be adjusted to various lengths. The adjustment is accomplished by providing lower mandrel 59 with an outer sleeve 61 and securing sleeve 61 to lower mandrel 59 with threads 63. Slots 65 are provided in the lower end of lower mandrel 59. Employing a tool to rotate mandrel 59 relative to sleeve 61 will increase the total length of mandrel 59. Once adjusted, sleeve 61 moves in unison with lower mandrel 59 as lower mandrel 59 moves from the initial position of FIG. 1B to the lower position of FIG. 2B.

A lower seal 67 is located on the outer diameter of sleeve 61 for sealing against the inner diameter of lower bore portion 23. An upper seal 68 is located on the outer diameter of sleeve 61 for sealing against lower bore portion 23. While lower mandrel 59 is in the upper position of FIG. 1B, both seals 67 and 68 are located above ports 65, allowing fluid to flow in or out of ports 65, which communicate with an annulus surrounding the pipe string. When moved to the lower position of FIG. 2B, upper seal 68 is above ports 65 and lower seal 67 is below ports 65, blocking communication between bore 23 and the annulus surrounding the pipe string through ports 65. Lower seal 67 is preferably configured to avoid being damaged as it moves downward past ports 65. A ring 69 may be secured to the lower end of lower mandrel 59 to retain lower seal 67.

It is important to make sure that ball 47 cannot be released before seal 67 is in sealing engagement with lower bore portion 23*e* below port 25. To make sure that ball 47 does not release in advance of seal 67 sealing below ports 25, enlarged diameter portion 23*d* is placed so that ball 47 can be forced through segments 37 only after lower seal 67 is in sealing engagement with lower bore portion 23*e*. The distance that ball seat 35 must travel before it can be expanded fully in enlarged diameter portion 23*d* is greater than the distance lower seal 67 travels from the upper position in FIG. 1B to a sealing engagement position in lower bore portion 23*e* below ports 25. Valve seat 35 and lower mandrel 59 continue to move downward a short distance after lower seal 67 is in sealing engagement with lower bore portion 23*e* to allow ball seat 35 to fully expand. The downward movement of valve seat 35 and lower mandrel 59 is stopped by retainer ring 69 abutting shoulder 33, as shown in FIG. 2B.

Lower mandrel 59 is held in its initial or upper position by a shear member arrangement. In this embodiment, the arrangement includes a ring 71 that rests on lower adapter rim 31 within enlarged diameter bore portion 23*d*. One or more shear screws or pins 73 extend through radial holes formed in ring 71 and the upper portion of lower mandrel 59. Shear pins 73 are sized to shear upon application of sufficient downward force. The downward force is applied by a selected level of fluid pressure acting on seat assembly 35.

Valve assembly 11 may be used for several operations. One occurs when lowering a pipe string, such as a liner, into an open bore hole. If the only opening in the pipe string is at the lower end, the speed of descent of the pipe string has to be kept low enough to avoid drilling fluid surge against the earth formation. If valve assembly 11 is in the open position while lowering the pipe string, fluid can flow in through open ports 25 (FIG. 1B) as well as into the lower end of the pipe string. The operator can lower the pipe string at a higher rate.

In this type of operation, valve assembly 11 is assembled as shown in FIGS. 1A and 1B. During assembly, seat assembly 35 is pushed upward against tapered shoulder 29 by lower mandrel 59. Engaging a tool with lower mandrel slots 65 and rotating lower mandrel 59 relative to sleeve 61 will cause lower mandrel 59 to snuggly press seat assembly 35 against tapered shoulder 29. Valve assembly 11 is secured into a well pipe string and lowered into a well.

While deploying the pipe string, fluid will move from the bore hole annulus through the ports 25 and into the bore 23. When the operator wishes to shut off communication between bore 23 and the annulus, he dispenses a drop member, such as ball 47, into the pipe string. Ball 47 may be pumped down or drop by gravity. After landing on seat surface 45, the operator pumps fluid into the pipe string to a selected pressure level. That level causes shear pins 73 to shear. The force of the well fluid flow plus the force of spring 53 pushes seat assembly 35 downward into enlarged bore portion 23*d* as shown in FIGS. 2B and 4. The larger diameter allows segments 37 to move radially outward, opening passage 43 to an inner diameter larger than ball 47. Ball 47 thus moves downward through passage 43 and out the lower end of valve assembly 11. Seal 48 on the outer diameter of seat assembly 35 expands in diameter as well, and may contact the inner diameter of enlarged diameter portion 23*d*.

Also, when seat assembly 35 moves downward in housing 13, upper and lower mandrels 49, 59 move downward in unison with seat assembly 35. A lower portion of upper mandrel 49 moves into seat receptacle 23*c*. Lower seal 67 on sleeve 61 of lower mandrel 59 moves below ports 25, while upper seal 68 remains above. Seals 67 and 68 seal to the inner diameter of lower bore portion 23*e*, blocking further flow through ports 25. The lower end of lower mandrel 59 abuts shoulder 33 (FIG. 2B), stopping further downward movement of seat assembly 35. The segments 37 of seat assembly 35 remain within bore enlarged diameter portion 23*d*.

If running a liner string, the operator may wish to pump cement down the pipe string, and the cement flows through valve assembly 11 to the lower end of the string. Ports 25 will be closed to assure that no cement can flow out ports 25.

If another seat assembly (not shown) is located below valve assembly 11, it will normally have a larger diameter than the initial diameter of seat assembly passage 43. After passing through seat assembly 35, ball 47 will pass through the lower seat assembly without actuating the lower seat assembly because it will be smaller in diameter. The operator may later drop a larger diameter ball (not shown); which moves unimpeded through the expanded seat assembly 35 and lands on the lower seat assembly. Increasing the fluid pressure causes the lower seat assembly to shift to perform a specified function. Valve assembly 11 can be re-used by retrieving the pipe string and resetting the components of valve assembly 11.

The valve assembly has significant advantages. The valve assembly is assured to have shifted from its first position to its second position before the ball is released. If other ball seat tools are located below the valve assembly, other balls can be disposed through the valve assembly to the other tools. The other balls may have diameters larger than the initial ball, yet will freely move through the upper valve seat assembly after it has been moved to the expanded position. No additional pressure would be required to dispense a subsequent ball through the upper valve seat assembly after it is in the expanded position.

While shown in only one of its forms, it should be apparent to those skilled in the art that changes may be made to the valve assembly. The valve seat tool could be employed for shutting off flow of fluid pumped down the pipe string from the annulus. Also, the expandable seat could be employed for other functions closing a circulation port to the annulus. For example, the axial shift movement of the valve assembly could open ports previously closed. The fluid flow through the ports could be used for other purposes, such as supplying fluid to actuate other downhole tools.

The invention claimed is:

1. A well tool apparatus, comprising:

a tubular housing having upper and lower ends for coupling into a pipe string extending into a well, the housing having an axially extending bore, the bore having an enlarged diameter portion;

a drop member seat assembly in the bore in a first position above the enlarged diameter portion for receiving a drop member conveyed down the pipe string, the seat assembly having a passage therethrough that is blocked by the drop member after the drop member lands on the seat assembly;

a retainer that retains the seat assembly in the bore above the enlarged diameter portion, the retainer allowing the seat assembly to move downward from the first position to a second position in the enlarged diameter portion in response to a selected fluid pressure applied in the bore above the seat assembly after the drop member has landed on the seat assembly;

the seat assembly being radially expansible to an expanded position while in the enlarged diameter portion so as to enlarge a diameter of the passage sufficiently to allow the drop member to pass through the passage; and an annular spring in the bore and cooperatively with the seat assembly to urge the seat assembly to the expanded position.

2. The apparatus according to claim 1, further comprising:

a tubular mandrel located in the bore, the mandrel having an end in abutment with the seat assembly and a shoulder axially spaced from the end of the mandrel; wherein the annular spring encircles the mandrel and is compressed between a portion of the housing and the shoulder on the mandrel to apply an axial force to the mandrel, which transfers the axial force to the seat assembly; and the mandrel is axially movable with the seat assembly while the seat assembly moves from the first to the second position.

3. The apparatus according to claim 1, further comprising:

a tubular upper mandrel located in the bore, the upper mandrel having a lower end in abutment with an upper side of the seat assembly and a shoulder axially spaced above the seat assembly; wherein the annular spring encircles the mandrel and is compressed between an upper portion of the housing and the shoulder on the upper mandrel to apply a downward axial force to the upper mandrel, which transfers to the seat assembly;

the lower end of the upper mandrel in abutment with the seat assembly is tapered to create an outward lateral force on the seat assembly urging the seat assembly to the expanded position; and the upper mandrel is axially movable with the seat assembly while the seat assembly moves from the first to the second position.

4. The apparatus according to claim 1, further comprising:

a tubular upper mandrel carried in the bore for axial movement relative to the housing, the upper mandrel having a lower end in abutment with an upper side of the seat assembly;

tubular lower mandrel separate from the upper mandrel and having an upper end in abutment with a lower side of the seat assembly;

the upper and lower mandrels being downwardly movable with the seat assembly while the seat assembly moves from the first to the second position;

a port in a sidewall of the housing;

a seal on the lower mandrel that blocks fluid communication between the bore and the port while in the second position and allows fluid communication between the bore and the port while in the first position.

5. The apparatus according to claim 1, further comprising:

a tubular lower mandrel having an upper end in abutment with the seat assembly while the seat assembly is in the first position, the lower mandrel being downwardly movable with the seat assembly while the seat assembly moves from the first to the second position; and wherein the retainer comprises:

a shear member coupled between the housing and the lower mandrel, the shear member shearing to allow the lower mandrel and the seat assembly to move downward in response to the selected pressure.

6. The apparatus according to claim 5, wherein the lower mandrel comprises inner and outer telescoping sleeves secured to each other by threads such that rotating one of the sleeves relative to the other changes a length of the lower mandrel.

7. The apparatus according to claim 1, further comprising:

a downward facing shoulder in the bore against which an upper portion of the seat assembly abuts while in the first position; and wherein the downward facing shoulder prevents upward movement of the seat assembly in the bore from the first position, but allows downward movement of the seat assembly to the second position.

8. A well tool apparatus, comprising:

a tubular housing having upper and lower ends for coupling into a pipe string extending into a well, the housing having an axially extending bore, the bore having an enlarged diameter portion;

a drop member seat assembly in the bore in a first position above the enlarged diameter portion for receiving a drop member conveyed down the pipe string, the seat assembly having a passage therethrough that is blocked by the drop member after the drop member lands on the seat assembly;

a retainer that retains the seat assembly in the bore above the enlarged diameter portion, the retainer allowing the seat assembly to move downward from the first position to a second position in the enlarged diameter portion in response to a selected fluid pressure applied in the bore above the seat assembly after the drop member has landed on the seat assembly;

the seat assembly being radially expansible while in the enlarged diameter portion so as to enlarge a diameter of the passage sufficiently to allow the drop member to pass through the passage;

a tubular upper mandrel carried in the bore for axial movement relative to the housing, the upper mandrel having a lower end in abutment with the seat assembly;

a spring that applies a bias force to the upper mandrel and the seat assembly in a downward direction;

a tubular lower mandrel having an upper end in abutment with the seat assembly while the seat assembly is in the first position, the upper and lower mandrels being downwardly movable with the seat assembly while the seat assembly moves from the first to the second position; and wherein the retainer comprises:

a shear member cooperatively mounted between the housing and the lower mandrel, the shear member shearing to allow the upper and lower mandrels and the seat assembly to move downward in response to the selected pressure.

9. The apparatus according to claim 1, further comprising:

a port in a sidewall of the housing;

a mandrel carried in the bore for movement in unison with the seat assembly from the first position to the second position;

a seal on the mandrel that blocks fluid communication between the bore and the port while in the second position and allows fluid communication between the bore and the port while in the first position; and wherein the distance the mandrel travels before the seat blocks fluid communication between the bore and the port is less than the distance the seat assembly must travel before the diameter of the passage enlarges sufficiently to allow the drop member to pass through the passage; and the annular spring encircles the mandrel.

10. A well tool apparatus, comprising:

a tubular housing having upper and lower threaded ends for coupling into a pipe string extending into a well, the housing having an axially extending bore, the bore having a seat receptacle portion adjoining and directly above an enlarged diameter portion that has a larger diameter than a diameter of the receptacle portion;

a drop member seat assembly comprising a plurality of pie-shamed segments spaced circumferentially around in side-to-side abutment with each other, defining while in an initial position a central passage having an initial inner diameter;

a mechanical annular spring mounted in the bore in cooperative engagement with the seat assembly;

while in the initial position, the seat assembly being located in the receptacle portion of the bore for receiving a drop member conveyed down the pipe string, which blocks the passage after landing on the seat assembly, the spring exerting an axial force on the seat assembly prior to conveying the drop member down the pipe string;

a retainer cooperatively engaged with the housing that releasably retains the seat assembly in the receptacle portion and allows the seat assembly to move downward from the receptacle portion into the enlarged diameter portion in response to a selected fluid pressure applied in the bore above the seat assembly after the drop member has landed on the seat assembly;

the segments of the seat assembly being radially outwardly movable while in the enlarged diameter portion so as to enlarge the initial inner diameter of the passage sufficiently to allow the drop member to pass through the passage; and wherein the axial force on the seat assembly exerted by the spring has a lateral component that pushes the segments radially outward in the enlarged diameter portion after the retainer releases the seat assembly.

11. The apparatus according to claim 10, further comprising:

a tubular mandrel located in the bore, the mandrel having an end in abutment with the seat assembly and a shoulder axially spaced from the end of the mandrel; wherein the annular spring encircles the mandrel and is compressed between a portion of the housing and the shoulder on the mandrel to apply the axial force to the mandrel, which transfers to the seat assembly; and the mandrel is axially movable with the seat assembly while the seat assembly moves from the initial position to the enlarged diameter portion of the bore.

12. The apparatus according to claim 10, further comprising an annular elastomeric seal mounted to and extending around the segments, the seal moving with the segments and stretching while the seat assembly moves to the enlarged diameter bore portion.

13. The apparatus according to claim 10, further comprising:

a tubular lower mandrel having an upper end in abutment with the seat assembly while the seat assembly is in the receptacle portion, the lower mandrel being downwardly movable with the seat assembly while the seat assembly moves into the enlarged diameter portion, and wherein the retainer spring is located in the bore above the seat assembly and the lower mandrel.

14. The apparatus according to claim 13, wherein the lower mandrel comprises inner and outer telescoping sleeves secured to each other by threads such that rotating one of the sleeves relative to the other changes a length of the lower mandrel.

15. The apparatus according to claim 10, further comprising:

a tubular upper mandrel carried in the bore for axial movement relative to the housing, the upper mandrel having a lower end in abutment with the seat assembly;

a tubular lower mandrel having an upper end in abutment with the seat assembly, the upper and lower mandrels being downwardly movable with the seat assembly while the seat assembly moves into the enlarged diameter portion; and wherein the axial force applied by the spring is applied to the upper mandrel and is in a downward direction.

16. The apparatus according to claim 10, further comprising:

a port in a sidewall of the housing;

a mandrel carried in the bore for movement in unison with the seat assembly, the mandrel having an end in engagement with the seat assembly;

at least one seal on the mandrel that allows fluid communication between the bore and the port while the seat assembly is in the receptacle portion and blocks fluid communication between the bore and the port while the seat assembly is in the enlarged diameter portion;

wherein the distance the mandrel travels before the seat assembly blocks fluid communication between the bore and the port is less than the distance the seat assembly must travel before the inner diameter of the passage enlarges sufficiently to allow the drop member to pass through the passage; and the annular spring encircles the mandrel and is compressed between a portion of the housing and the housing, thereby applying the axial force to the mandrel, which transfers the axial force to the seat assembly.

17. A method of performing a well tool function, comprising:

(a) providing a housing with an axially extending bore having an enlarged diameter portion;

(b) providing a seat assembly that is radially expansible and has a passage therethrough, and releasably mounting the seat assembly in the bore above the enlarged diameter portion with a shearable retainer and with an annular spring that urges the seat assembly toward a radially expanded position;

(c) mounting the housing to a string of pipe and lowering the string of pipe into a well;

(d) conveying a drop member down the string of pipe and landing the drop member sealingly on the seat assembly; and (e) applying a selected fluid pressure to an interior of the string of pipe above the seat assembly, causing the retainer to shear, allowing the seat assembly to move into the enlarged diameter portion, which expands the seat assembly to the radially expanded position and increases a diameter of the passage sufficiently for the drop member to pass through.

18. The method according to claim 17, wherein:

step (c) further comprises pumping fluid down the pipe string and out a port within a side wall of the housing below the seat assembly; and the movement of the seat assembly into the enlarged diameter portion in step (e) closes the port.

19. The method according to claim 17, wherein step (b) further comprises:

extending a length of the annular spring while the seat assembly moves to the enlarged diameter portion.

20. The method according to claim 17, wherein:

step (b) comprises assembling a plurality of separate seat assembly segments in a circumferential array in side-to-side abutment with each other; and wherein the annular spring exerts an axial force on the segments.

* * * * *